United States Patent [19]

Monmarson

[11] 4,054,692

[45] Oct. 18, 1977

[54] METHOD OF IMPREGNATING AND DRYING MATERIALS AND INSTALLATIONS FOR CARRYING OUT THIS METHOD

[75] Inventor: Jean Monmarson, Vitry-sur-Seine, France

[73] Assignee: Mecalix S.A., Vitry-sur-Seine, France

[21] Appl. No.: 641,873

[22] Filed: Dec. 18, 1975

[30] Foreign Application Priority Data

Dec. 19, 1974 France ..... 74.42052

[51] Int. Cl.[2] ..... B05D 3/00; B05D 1/18

[52] U.S. Cl. ..... 427/296; 118/50; 427/439

[58] Field of Search ..... 427/296, 297, 439; 118/50

[56] References Cited

U.S. PATENT DOCUMENTS

| | | | |
|---|---|---|---|
| 1,723,747 | 8/1929 | Pearce | 427/296 |
| 2,280,216 | 4/1942 | Campbell et al. | 427/296 |
| 2,303,257 | 11/1942 | Campbell et al. | 427/296 |
| 2,730,462 | 1/1956 | Ewing | 427/296 X |

*Primary Examiner*—Michael R. Lusignan

*Attorney, Agent, or Firm*—Cushman, Darby & Cushman

[57] ABSTRACT

This specification discloses a method of impregnating and drying material such as cardboard or corrugated cardboard preliminary shaped or not, comprising a certain number of steps and more particularly a step of impregnating cardboard located inside a sealed container by means of an impregnating liquid which is formed by impregnating substance and solvent, a step of drying the cardboard still located inside said container and a step of recovering the solvent during the step of drying in view to recycle it.

6 Claims, 2 Drawing Figures

14
15
11
51
46
47
31
30
32
30
33
25
50
32a
60
41
26
34
42
27
28
16
36
35
18
17
18
21
22
23
19
19
20

14
47a
45
46
15
11b
51b
47b
47c
31b
31c
31a
30
32
30
33
11a
11c
29b
29c
29a
25
50
51a
32a
60
41b
51c
41a
41c
40
42
26
34
27
28
16
36
35
18
17
18
19
21
22
23
19
20

METHOD OF IMPREGNATING AND DRYING MATERIALS AND INSTALLATIONS FOR CARRYING OUT THIS METHOD

The present invention relates to a method of impregnating and drying materials, and in particular porous materials such as cardboard preliminary shaped or not for packaging purposes, with the object of improving their mechanical strength and/or sealing them to some degree. The invention also relates to an impregnating installation which in particular allows the aforementioned method to be carried out.

The impregnation of materials of this type, which at the industrial stage, are usually in the form of sheets or rolls, is generally carried out with an impregnating liquid which is chiefly formed by a solvent containing the impregnating substance proper (which may be resin for example). The impregnating substance may also be present in the form of fine particles suspended, in the solvent, that is to say which are indissolved or incompletely dissolved. Whatever the nature of the impregnating liquid, it is always necessary to dry the materials being treated at the end of impregnation, that is to say to remove all traces of solvent. This operation is generally performed by placing the still wet materials in an oven or tunnel through which hot air flows.

Besides the fact that the materials being treated have to be transported from the point at which they are impregnated to the point at which they are dried, such a procedure is both unhealthy and dangerous for the personnel who undertake the operations. The solvents used to produce the impregnating liquid are in fact normally toxic and highly inflammable. In particular, there is a very serious risk of the hot air and the solvent vapours which are generated in the oven or tunnel forming an explosive mixture. Consequently, it is necessary to lay down very strict safety standards for such installations both because of the unhealthy conditions and because of the risk of explosion. The need for these standards to be met necessarily results in a considerable increase in the manufacturing cost of impregnating installations. Furthermore, a considerable amount of non-recoverable energy is expended in producing the hot air and there is also a not inconsiderable loss of solvent.

An object of the present invention is to overcome these drawbacks and relates to a method of impregnating material, in particular, material such as a cardboard (or corrugated carboard) for packaging purposes, deriving its advantage, chiefly from the fact that the entire impregnating treatment takes place in a sealed conatiner which is shut off from the oxygen of the air and that the solvents employed are recovered and recycled.

Another object of the present invention is to provide a method of uniformly impregnating the cardboard throughout its structure, the result being improved physical and mechanical characteristics.

Still another object of the present invention is to provide a method of impregnating with immersion of cardboard in a volum of liquid, the result being that said liquid may contain, in solution, or dispersion, any additive substance which allows the cardboard to be endowed with special additional characteristics such as fire-proofing and colouring, better resistance to insects, termites, bacteria...

The invention, more particularly relates to a method of impregnating materials, in particular materials such as a cardboard for packaging purposes with an impregnating liquid which is formed with impregnating substance and solvent, said method comprising the steps of isolating the material in a sealed treatment container, removing substantially all traces of oxygen from said treatment container; introducing into and maintaining during a treatment period, said impregnating liquid in said treatment container; evacuating said impregnating liquid after said treatment; creating a vaccum in said treatment container to extract all traces of solvent by pumping; condensing the extracted solvent with a view to recovering and recycling it. The invention also relates to an installation to carry out the aforementioned method, said installation comprising at least one sealable treatment container, at least a tank for the impregnating liquid; a circuit for filling said container, a circuit for emptying said container and means for extracting said solvent.

The invention will be better understood and the foregoing and other objects, features and advantages will be more clearly apparent from the following description, which is given solely by way of example, and which refers to the accompanying schematic drawings in which.

Figure 1:
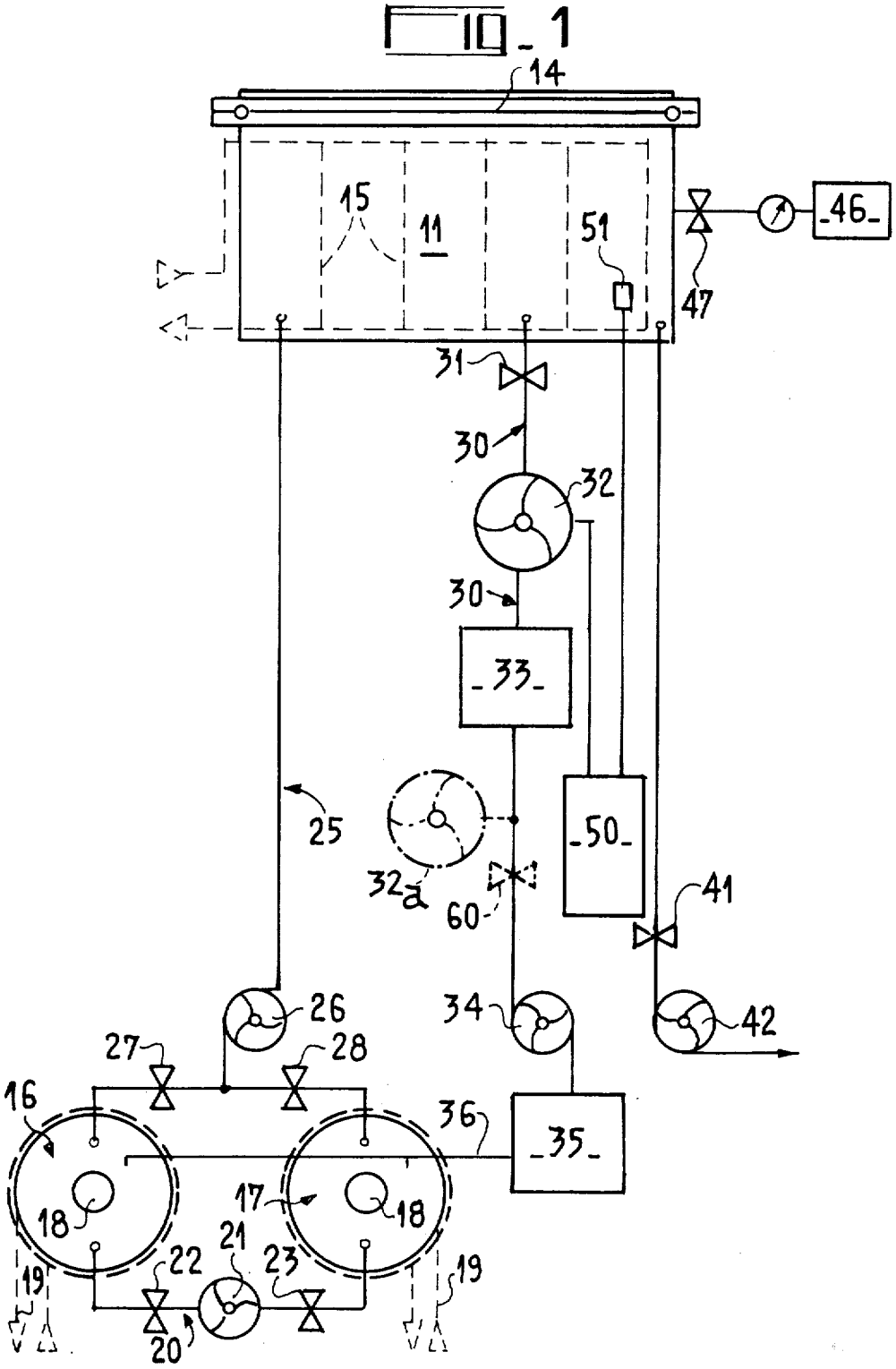
FIG. 1 is a schematic view of a single container embodiment of an impregnation treatment installation to carry out the method of impregnating according to the invention.

FIG. 1 illustrates an installation which comprises a sealable container or vat 11 comprising, a sealable cover 14 and a heating circuit 15 which is indicated in broken lines. The installation also includes two tanks 16 and 17 for impregnating liquid. Each tank is sealed and equipped with a stirring device 18 and a heating circuit 19 which is indicated in broken lines. It should be pointed out that heating circuits 15 and 19 are formed by pipes through which a heat-bearing fluid (such as hot water) flows, the pipers being so arranged as to promote the transfer of heat through the walls of the said pipes and into the container and tanks. In this way the said heat-bearing fluid heats the substances contained in the container or tanks indirectly, that is to say without being mixed with or in direct contact with them. Impregnating liquid may be submitted inside the tanks 16 or 17 a pressure. In this condition the temperature of impregnating liquid is increased. For example, to an increase of 0.5 bar of pressure corresponds an increase of temperature of 20° C everything remaining the same. For this prupose the tanks are tight to a determined pressure. Impregnating liquid may be transferred directly from one tank to the other by means of a connecting circuit 20 which includes, inter alia, a pump 21 and two control valves 22 and 23. Tanks 16 and 17 communicate with container 11 by means of a circuit 25 which is used both to fill the container with impregnating liquid and to empty it at the end of treatment. This is made possible by the fact that the pump 26 in the circuit 25 is of the reversible type. Valves 27 and 28 allow the impregnating liquid to be drawn from or returned to either of tanks 16 and 17. The installation further includes a circuit 30 for extracting and recovering evaporated solvent from container 11. This circuit includes a valve 31, a vacuum pump 32 and a condenser 33. The latter is connected, via a pump 34, to a buffer tank 35 whose output 36 communicates with the two tanks 16 and 17. The installation also includes a pumping circuit which enables a vacuum to be generated in the container. This circuit includes a valve 41 and a vacuum pump 42. Similarly, a circuit for supplying an inert gas (such as nitrogen) includes a vessel 46 for pressurised gas which can be connected to the treatment container 11 by means of a valve 47. Finally, it will be noted that there is a control device 50 which is connected to a temperature sensor 51 situated in the treatment container. In the embodiment described, this control device acts on pump 32.

Figure 2:
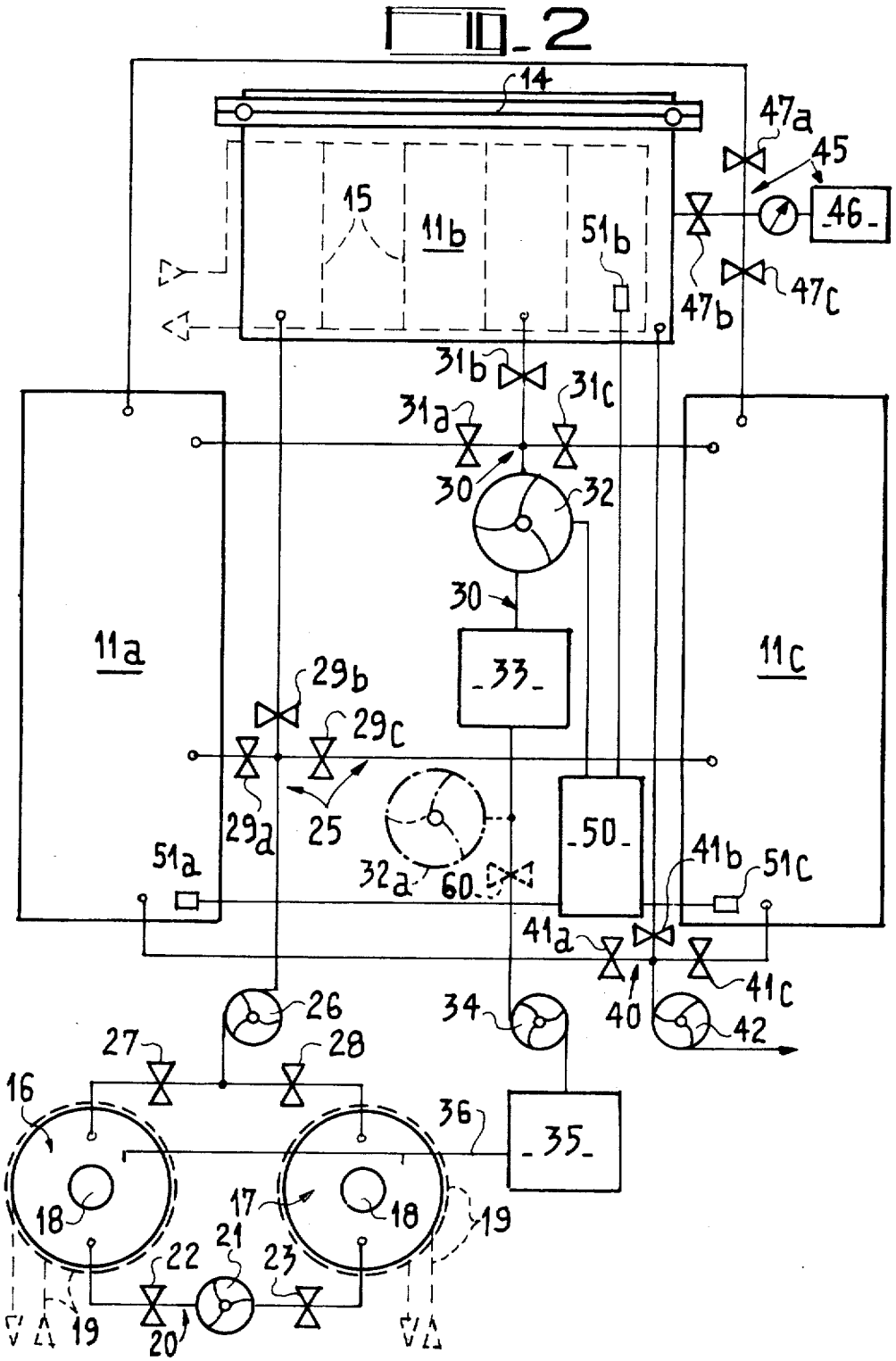
FIG. 2 is a schematic view of a multi-container embodiment of an installation according to the invention. Similar components carry the same reference numerals in both figures.

Referring now to FIG. 2, there is seen a full installation which has three sealable treatment containers 11*a*, 11*b* and 11*c*. These vats or containers are identical to that described with reference to FIG. 1 and are preferably intended to be used in sequence following a procedure which will be analysed below. Container 11*b* is shown in greater detail than containers 11*a* and 11*c* and it can be seen to have, inter alia, as in the case of FIG. 1, a sealable cover 14 and a heating circuit 15 which is indicated in broken lines. The same members are also present in the case of containers 11*a* and 11*c*. The installation also includes two tanks 16 and 17 for impregnating liquid. Each tanks, which is sealed, is provided with a stiring device 18 and a heating circuit 19 which is indicated in broken lines. It should be noted that the heating circuits 15 and 19 are formed by pipes through which a heat-bearing so arranged as to promote the transfer of heat through the walls of the said pipes and into the containers or tanks. In this way the said heat-bearing fluid heats the substances contained in the containers or tanks indirectly, that is to say without being mixed with or in direct contact with them. Impregnating liquid may be transferred directly from one tank to the other by means of a connecting circuit 20 which includes, inter alia, a pump 21 and two control valves 22 and 23.

Tanks 16 and 17 are able to communicate with all the treatment containers 11*a*, 11*b* and 11*c* means of a single circuit 25 which is used both to fill the said containers with impregnating liquid and to empty them at the end of treatment. This is made possible by the fact that the pump 26 included in the circuit is of the reversible type. Valves 27 and 28 allow the impregnating liquid to be drawn from or returned to either of tanks 16 and 17. A group of three valves 29*a*, 29*b* and 29*c* enables one of the three treatment containers to be selected and connected to tank 16 or 17. The installation further includes a circuit 30 for removing and recovering evaporated solvent from containers 11*a*, 11*b* and 11*c*. This circuit includes a vacuum pump 32, a condenser 33 and a group of three valves 31*a*, 31*b* and 31*c* which perform a selecting function identical to that of valves 29. The condenser is connected, via a pump 34, to a buffer tank 35 whose output 36 communicates with the two tanks 16 and 17.

The installation also includes a pumping circuit 40 which enables a vacuum to be generated in the treatment containers. This circuit likewise includes a set of three selecting valves 41*a*, 41*b* and 41*c* which allow one of the treatment containers to be connected to a vacuum pump 42. In a similar way, a circuit 45 for supplying an inert gas (for example nitrogen) includes a vessel 46 for pressurised gas which can be connected to any one of the treatment containers by means of a further group of three selecting valves 47*a*, 47*b* and 47*c*. Finally, it will be seen that there is a control device 50 connected to temperature sensors 51*a*, 51*b* and 51*c*, each of which is situated in one of the treatment containers. In the embodiment described this control device acts on pump 32.

The installations which have been described operate in the manner described below. Operation will first be described for the case where the installation has only one treatment containers. Container 11 is loaded with materials to be impregnated, which may possibly be preheated, and once the sealable cover has been closed, a vacuum is generated in the container 11 by means of pump 42. Then the impregnating liquid, which has meanwhile been brought to a suitable composition and temperature in one of the tank 16 and 17 (which is selected by means of valves 27 and 28), is fed into the treatment container via pump 26. After a certain treatment period of impregnation, the impregnating liquid is returned through circuit 25 to the tanker, by means of the reversible pump 26. At this moment, the drying phase proper may begin.

In effect, after the treatment container has been emptied, a considerable quantity of solvent remains in it, both in liquid form soaked up by the material, and lying in the bottom of the container and remains only in gaseous form, because the air previously pumped out can only be replaced by solvent vapour. Drying is initiated both by the heat released by heating circuit 15 and by the vacuum created in the treatment container by pump 32, which accelerates evaporation. The solvent vapour drawn in by pump 32 is condensed in condenser 33 and the liquid which forms in the condenser is removed, as it forms, by pump 34, which feeds it for storage in the buffer tank 35. The solvent so recovered may be fed back to the tanks 16 and 17. When substantially all the solvent has been removed from treatment container 11, a vacuum again exists therein and it is necessary to feed in nitrogen (circuit 45) so that the cover can be opened and unloading can commence.

It will be noted that there is control system 50 which is intended to control the rate of evaporation and of recovery of the solvent. It is desirable for the rate of evaporation to be controlled, in particular to prevent bubbles forming locally in the actual structure of the materials to be impregnated, which bubbles would considerably detract from the quality of impregnation. For this purpose, it is necessary to establish a correct relationship between the temperature and the pressure which prevail within the treatment container. It is for this reason that control system 50 is governed by temperature sensor 51 and acts on pump 32 so as to regulate vapour pressure as a function of temperature.

In cases where the installation has a plurality of treatment containers, for example three as shown in FIG. 2, each of the containers 11*a*, 11*b* and 11*c* operates in an identical way to that described above in the case of the single container 11.

The installation is intended to allow one complete impregnation and drying cycle to be carried out in each treating container. Bearing in mind the time required to load and unload the materials, the operating cycles of the three containers may be staggered so that at any given time one container is being loaded, another is in operation, and the third is being unloaded. Assuming that treatment container 11*b* has just been loaded with materials to be impregnated, which may possibly be preheated, and that the sealable cover is closed, a vacuum is created in the container by means of pump 42, valve 41*b* being open and valves 41*a* and 41*c* being closed. Then the impregnating liquid, which meanwhile has been brought to a suitable composition and temperature in one of tank 16 and 17, is fed into container 11*b* via pump 26 and valve 29*b*. After a certain impregnation period, the impregnating liquid is returned via the same circuit 25 to the tanks, by means of the reversible pump 26. The drying phase proper may begin at this moment.

All that was said above concerning the operation of treatment container 11 is equally true for the operation of each of the containers in an installation which has a plurality of containers. The control system 50 is governed by the appropriate temperature sensor 51*b* and acts on pump 32 so as to regulate the vapour pressure as a function of the temperature. Sensors 51*a* and 51*c* are switched into circuit in place of sensor 51*b* (by means which are not shown) when the corresponding treatment containers are in use.

As stated above, a vacuum is created in the container prior to the liquid immersion of the packaging materials. The result is an absence of air and a reduction in moisture content. This enables corrugated cardboard to be uniformly impregnated throughout its structure and herein lies one of the important features of the invention. The result is in fact appreciably improved physical and mechanical characteristics such as, for example, mechanical strength which is increased by 60% for a resin content of only 15% by weight of cardboard, stronger glued joins and better resistance to humidity. Furthermore, for the same mechanical strength it is possible by this method to make a saving of at least 30% in cellulose.

In addition the method, permitting as it does the use of resin in solution, gives a finished product which can be recycled.

Furthermore, since immersion takes place in a volume of liquid, the liquid may contain in solution or dispersion any additive which allows the cardboard to be endowed with special additional characteristics, such as fire-proofing and colouring, and the treatment of packaging materials for better resistance to insects, termites, bacteria and mould.

It will be understood that the invention is not limited either to the method just described or to a particular embodiment of the installation intended to carry it out. In particular, it is possible to make numerous structural alterations to the installation. Thus, the single circuit 25 mau be divided into two separate circuits, one to fill the vat and the other to empty it. Similarly, many modifications may be made to the changeover means which allow one or other of the treatment containers to be selected. It is possible to use a different number of treatment containers and it is similarly perfectly possible to have a number of containers operating simultaneously. Also, the method itself may be considerably modified and it may for instance be advantageous in certain cases to feed nitrogen into the container as soon as the latter has been emptied to avoid any risk of the solvent forming bubbles locally in the actual structure of the material. In addition, in a modification which is shown in chain lines, pump 32 may be positioned, as shown at 32*a*, on a branch from the circuit 30 which connects condenser 33 and buffer tank 35, a valve 60 being provided in this circuit 30 between the two members 33 and 35 downstream of condenser 33, assuming the fluid to be folwing from the condenser 33 to buffer tank 35.

Under these conditions, after having loaded the materials into container 11b, the container is evacuated by pump 32*a*, valve 31b being open and valve 60 closed. The required vacuum having been attained, valve 31*b* is closed and pump 32*a* stopped. Treatment of the materials then continues as described above.

While the invention has been particularly shown and described with reference to preferred embodiment, it will be understood by those skilled in the art that the foregoing and the other changes in the form and details may be made therein without departing from the scope of the invention.

What is claimed is:

1. A method of impregnating and drying cardboard for packaging purpose with impregnating liquid which is formed by an impregnating substance and solvent, said method comprising the steps of isolating the material in a sealed treatment container; introducing and maintaining during the treatment period, said impregnating liquid into said treatment container; evacuating said impregnating liquid, after said treatment; creating a vacuum in said treatment container to extract all traces of solvent by pumping; recycling said solvent after pumping; said method further comprising the step of removing substantially all traces of oxygen from said treatment container before the step of introducing impregnating liquid; and the step of controlling the rate of evaporation and of recovery of the solvent to provent bubbles from forming locally in the cardboard.

2. A method of impregnating material according to claim 1, wherein before the step of introducing said impregnating liquid into said treatment container, said liquid is heated by conductive thermal contact with pipes through which a heat-bearing heating fluid flows.

3. A method of impregnating and drying material according to claim 2, wherein said heated liquid is sumitted to a pressure inside said tank.

4. A method of impregnating material according to claim 1, wherein said sealed treatment container is heated by conductive thermal contact with pipes through which a heat-bearing flows during the step of isolating the material in said container.

5. A method of impregnating and drying material according to claim 1, wherein said material is preheated before the step of isolating said material in said treatment container.

6. A method of impregnating and drying material according to claim 1 further comprising during step of introducing and maintening during said treatment period, a step of regulating vapour pressure into said container as a function of temperature.

* * * * *